US006792944B1

(12) United States Patent
Green et al.

(10) Patent No.: US 6,792,944 B1
(45) Date of Patent: Sep. 21, 2004

(54) AIR FILTRATION AND CONTROL SYSTEM INCLUDING HEADGEAR

(75) Inventors: Lawrence Green, Santa Ana, CA (US); Christopher Simbulan, Downey, CA (US)

(73) Assignee: Pabban Development Inc., Costa Mesa, CA (US)

( * ) Notice: Subject to any disclaimer, the term of this patent is extended or adjusted under 35 U.S.C. 154(b) by 22 days.

(21) Appl. No.: 10/082,281

(22) Filed: Feb. 26, 2002

(51) Int. Cl.[7] ..... A62B 17/04

(52) U.S. Cl. ..... 128/201.22; 128/202.22

(58) Field of Search ..... 128/201.22, 201.24, 128/201.29, 202.11, 202.22, 205.23, 205.25, 205.27, 207.11, 200.28, 201.23, 201.25, 200.27, 201.15, 206.12, 206.19, 206.21; 2/5, 171, 6.1, 173, 171.3, 418, 51

(56) References Cited

U.S. PATENT DOCUMENTS 4,893,356 A * 1/1990 Waters ..... 2/171.3
5,104,430 A * 4/1992 Her-Mou ..... 55/385.1
5,283,914 A * 2/1994 James ..... 4/424
5,329,637 A * 7/1994 Walker ..... 2/5
5,413,097 A * 5/1995 Birenheide et al. .... 128/206.17
5,561,855 A * 10/1996 McFall ..... 2/8
5,564,128 A * 10/1996 Richardson ..... 2/422
5,592,936 A * 1/1997 Thomas et al. ..... 128/206.12
5,711,033 A * 1/1998 Green et al. ..... 2/171.3
5,887,281 A * 3/1999 Green et al. ..... 2/171.3
5,906,203 A * 5/1999 Klockseth et al. ..... 128/205.24
5,931,559 A * 8/1999 Pfaeffle ..... 362/106
6,118,382 A * 9/2000 Hibbs et al. ..... 340/586
6,393,617 B1 * 5/2002 Paris et al. ..... 2/171.3
6,417,774 B1 * 7/2002 Hibbs et al. ..... 340/584
6,481,019 B2 * 11/2002 Diaz et al. ..... 2/171.3
6,615,828 B1 * 9/2003 Petherbridge ..... 128/200.28

* cited by examiner

*Primary Examiner*—Henry Bennett
*Assistant Examiner*—Teena Mitchell
(74) *Attorney, Agent, or Firm*—G. Donald Weber, Jr.

(57) ABSTRACT

An air flow and filtration control system in the form of a headgear which is worn by a physician during a surgical procedure, a technician during an assembly process, or any other user wherein controlled air flow and air filtration is required or desired. The system includes a lightweight headgear structure which substantially surrounds the upper portion of the head of the wearer. A fan is mounted in the headgear structure and is positioned to move air relative to the headgear structure. A shroud (or hood) can be draped over and attached to the headgear structure in such a fashion as to completely cover the headgear structure and to cover at least a portion of the wearer in order to maintain sterile or controlled environmental conditions relative to the wearer. Typically, the shroud may include at least one filtration area (which may comprise the entire shroud) and a screen at the front of the apparatus for viewing therethrough. A suitable power supply, such a battery pack or the like, is used to selectively power the fan. An air flow monitoring system is mounted on the helmet. An air flow indicator and/or a battery level indicator is also mounted to the helmet in a location readily detectable by the helmet wearer.

28 Claims, 4 Drawing Sheets

AIR FILTRATION AND CONTROL SYSTEM INCLUDING HEADGEAR

BACKGROUND

1. Field of the Invention

This invention is directed to air flow and filtration systems, in general, and, more particularly, to a headgear structure which is worn by an individual in an environment wherein control of filtered air is required.

2. Prior Art

There are several types of air flow and/or filtration systems which are known in the art. Several types of such systems are currently available on the market for use in surgical arenas, in "clean room" environments, or in hazardous/contaminated environments.

Some of the existing systems include hoods, gowns, filters, and the like. In some instances, the air filters are built into the helmet structure and produce a rather clumsy, cumbersome headgear unit. Known units frequently include external sources of air such as gas cylinders, air lines or the like which are connected to the helmet structure by tubes, hoses or the like. Of course, the hose-connected systems tend to become cumbersome and restrictive of the movements and flexibility of the wearer during a procedure.

Furthermore, many of the systems known in the art tend to produce an uneven airflow therethrough. This shortcoming has the effect of creating drafts in some locations and little or no airflow in other locations within the system. This situation can sometimes result in the transparent screen or shield in the hood or helmet becoming fogged due to condensation of expired air generated by the surgeon or technician during the procedures involved.

Alternatively, in the prior art systems, the air supplied to the wearer can be reduced and/or the positive pressure gradient can be reduced (or even lost) if the air flow is decreased due to filter loading, low battery or the like. Unfortunately, the wearer of the air supply system is unaware of the reduction, of air flow wherein the wearer can be at risk in such an operational environment.

Many such products are known in the prior art. One suitable and functional system is described in U.S. Pat. No. 5,054,480; PERSONAL AIR FILTRATION AND CONTROL SYSTEM, R. O. Bare et al.

Another such system is described in U.S. Pat. No. 5,711,033; AIR FILTRATION AND CONTROL SYSTEM, R. O. Bare et al.

SUMMARY OF THE INSTANT INVENTION

This invention is directed to a protective system which is worn by a surgeons during a surgical procedure, a technician during an assembly process, a worker during handling of toxic wastes, or the like. The system includes a relatively light weight, substantially rigid, headgear structure which may include an internal, adjustable headband. A fan mechanism is mounted on the headgear structure. A suitable power supply, such as a battery pack or the like, is used to selectively power the fan.

Typically, the system also includes a shroud which is adapted to be attached to or draped over the headgear structure to completely cover the structure and, as well, to cover a portion of the wearer in order to maintain sterile, non-contaminating conditions relative to the wearer (or the work product of the helmet wearer).

The system includes an air flow monitor which measures the air flow produced by the fan as well as a display for selectively indicating the air flow. Likewise, the system can also include a low battery detector and indicator.

DESCRIPTION OF A PREFERRED EMBODIMENT

Figure 1:
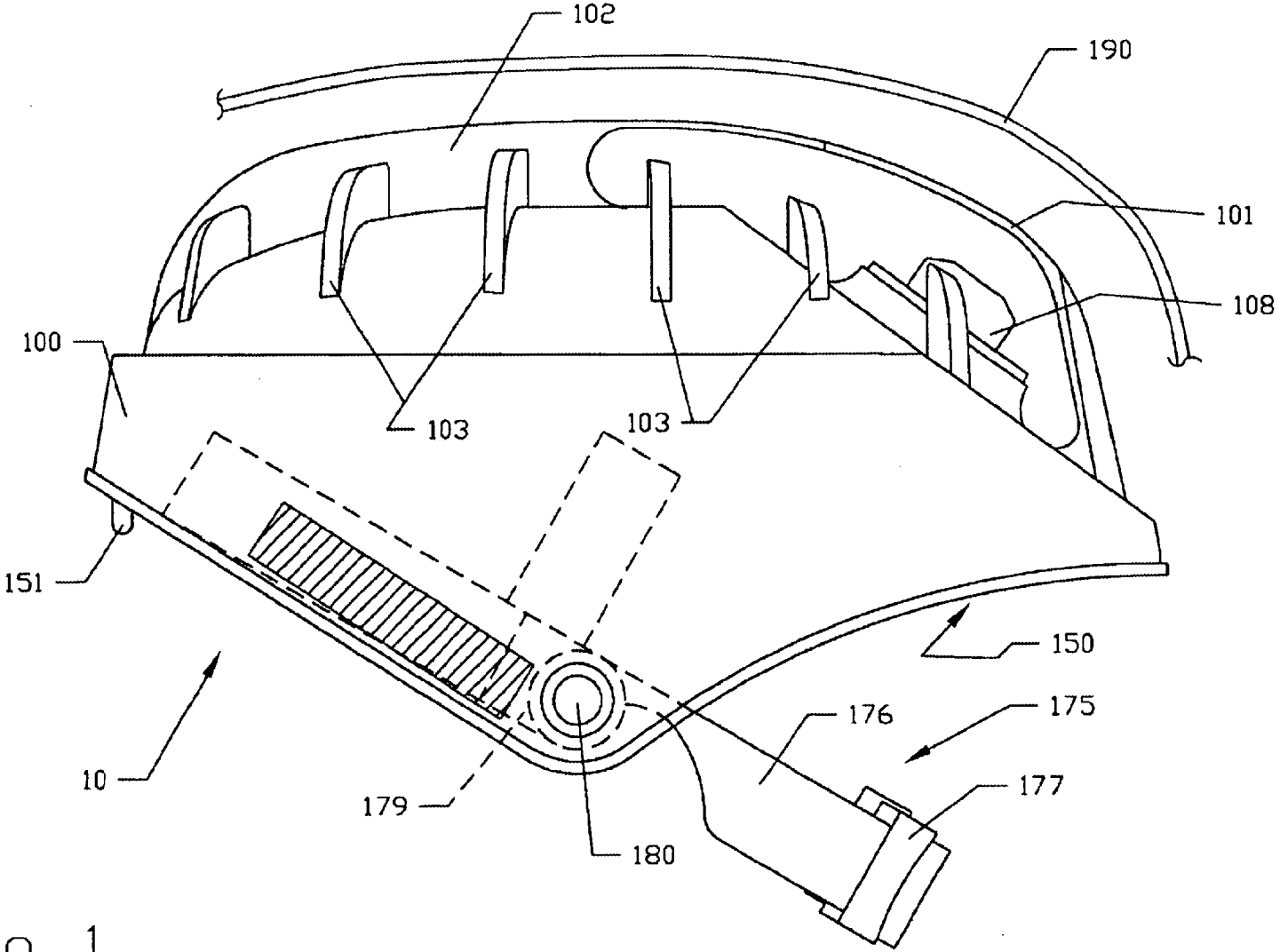
FIG. 1 is an elevation view of one embodiment of the helmet of the instant invention.

Referring now to FIG. 1, there is shown a side elevation view of one embodiment of the helmet 10 of the instant invention as assembled. The helmet 10 includes the outer shell 100, the inner liner 150 and the headband 175.

The headband 175 is used to seat the helmet 10 on the head of the wearer (not shown). The headband 175 is fairly conventional and is, also, optional. That is, if desired, a different head engaging support mechanism can be utilized or it can be omitted, if preferred.

The headband 175 includes the head-encircling band 176 which is adjustable to comfortably fit the head size of the individual wearer. The adjustment latch 177 permits the band 176 to be shortened or lengthened in a conventional manner.

An over-the-head strap 178 (see FIG. 2) is attached to the band 176 in any conventional fashion. The band 176 and strap 178 may be integrally formed, if so desired. The strap and band are formed of a suitable material, such as nylon, for example. While adjustment of the length of band 178 is contemplated, this is not a required feature of the invention, per se.

The headband 176 includes suitable attachment arms 179 (shown in dashed outline) which extend outwardly from the band. The arms 179 are provided for attachment to the liner 150 by means of suitable fasteners 180 which can be pan screws or the like.

The liner 150 is, typically, formed of a lightweight material, such as PETG or Polycarbonate, for example. The liner 150 (mounted within the outer shell 100 and shown in greater detail in FIG. 2) is configured to fit rather snugly within the outer shell 100 and is to be spaced away from the top of the head of the wearer. In addition, as will be described infra, the liner 150 is sufficiently sturdy so as to support a cooling or air moving mechanism 108, typically, e.g. fan or the like.

The outer shell 100, typically, is formed of a lightweight material, again a material such as PETG or Polycarbonate, for example. The outer shell 100 is configured to conform, generally, to the shape of the upper portion of the wearer's head. A fan covering 101 extends above the outer surface of outer shell 100 to provide a protective and contouring cover for the fan mechanism 108 described infra. In addition, the fan covering 101 provides a spacer for maintaining a distance between the shroud 190 (shown in partial outline) and the outer liner 100.

The fan covering 101 is joined with or includes an integrally formed central fin 102 which extends upwardly from the center of the outer surface of outer shell 100.

A plurality of radial fins 103 extend upwardly from the outer surface of the outer shell 100 and radiate outwardly from center of the outer shell 100 toward the perimeter thereof. The radial fins 103 may be integral with the central fin 102 although this configuration is not required.

The covering 101 and the fins 102 and 103 serve to support the protective hood 190 (also referred to as a shroud) above the outer shell 100. The covering and fins provide air flow channels around the helmet 10 whereby the fan mechanism 108 can provide a cooling second or filtered air flow to the wearer of the helmet 10.

Indicator device 151 depends from the helmet. Indicator device 151 can be a light emitting diode (LED) as described infra.

Figure 2:
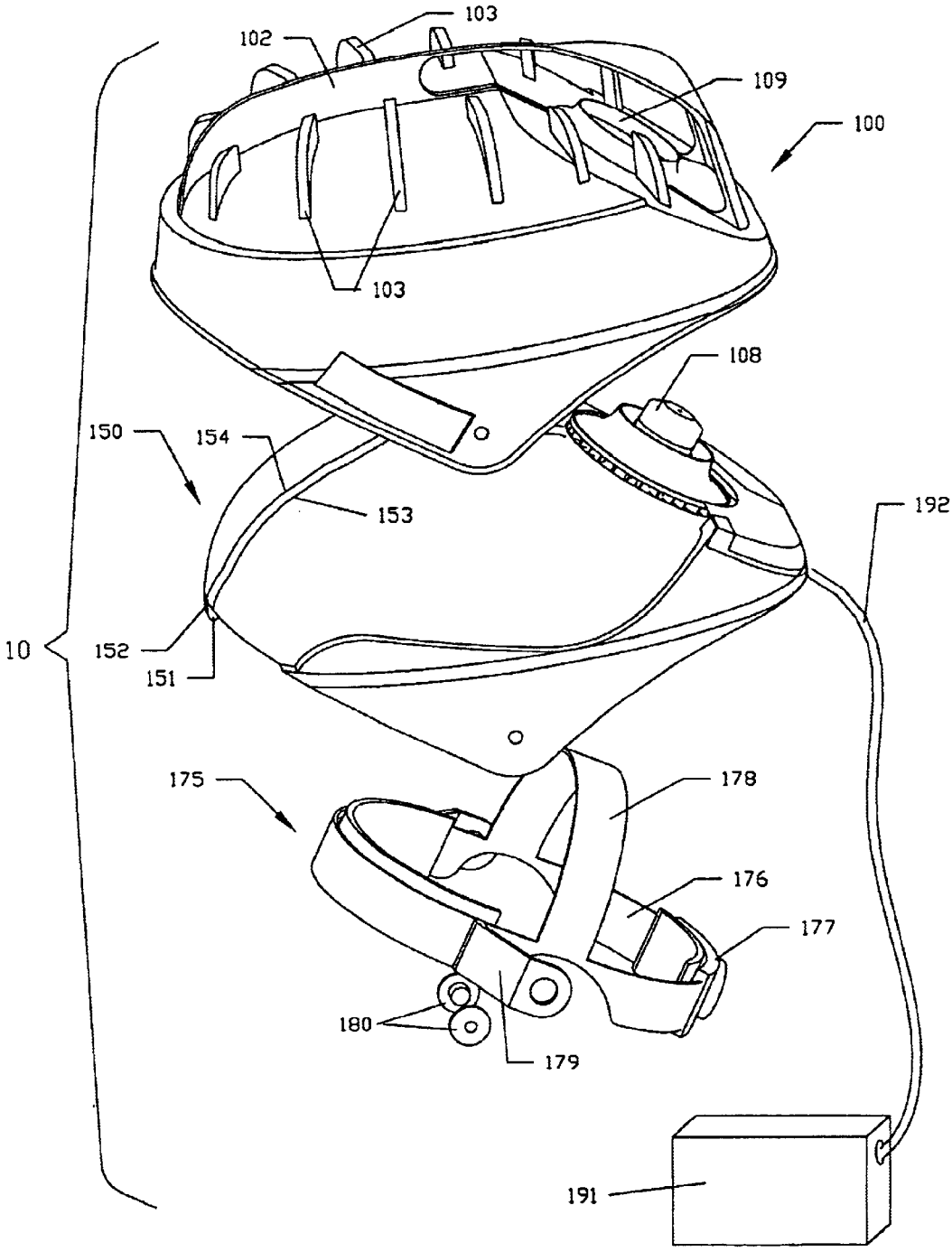
FIG. 2 is a partially exploded, side or elevation view of one embodiment of the headgear structure of the instant invention.

Referring now to FIG. 2, there is shown an exploded view of the helmet 10 As shown and described above relative to FIG. 1, the helmet 10 includes the outer shell 100, the inner liner 150 and the headband 175. The hood 190 (see FIG. 1) is omitted for convenience in this view As described supra, the headband 175 used to seat the helmet 10 on the head of the wearer (not shown) in a preferred embodiment. The headband 175 includes the head-encircling band 176 which is adjustable to comfortably fit the head size of the individual wearer. The adjustment latch 177 permits the band 176 to be shortened or lengthened in a conventional manner.

An over-the-head strap 178 is attached to the band 176 in any conventional fashion and may be integrally formed therewith, if so desired.

The headband 176 includes suitable attachment arms 179 which extend outwardly from the band 176 for attachment to the liner 150 by means of suitable fasteners 180 such as pan head screws 180 or the like.

The liner 150 is configured to fit rather snugly within the outer shell 100. Conversely, the liner 150 is configured to conform, generally, to the shape of the upper portion of the wearer's head. In addition, the liner 150 is sufficiently sturdy so as to support a cooling mechanism 108, e.g. a fan or the like. A schematic representation of fan 108 is shown mounted on the liner 150.

The outer shell 100 is configured to be spaced away from the top of the wearer's head. A fan opening 109 is provided through the rearward portion of the outer shell 100. A fan covering 101 extends above the outer surface of outer shell 100 to provide a protective and contouring cover for the fan mechanism described infra which may extend through the fan opening 109 in some designs.

The fan covering 101 is joined to and/or includes a central fin 102 which extends upwardly from the longitudinal center of the outer surface of outer shell 100.

A plurality of radial fins 103 extend upwardly from the outer surface of the outer shell 100 and radiate outwardly from the longitudinal center of the outer shell. The radial fins 103 may be integral with the central fin 102 although this configuration is not required.

The housing 101 and the fins 102 and 103 serve to support the protective hood 190 (also referred to as a shroud) above the outer shell 100. Thus, air flow channels can be defined and maintained wound the helmet 10 whereby the fan mechanism 108 can provide a cooling second or filtered air flow to the wearer of the helmet 10. The exploded view permits a clearer illustration of the components of the helmet.

Mounted at the front of the liner 150 are light emitting diodes (LED) 151 and 152 or similar indicating devices. These diodes are disposed so that they are readily observable by the wearer of helmet 10 without obscuring the view or otherwise distracting the wearer. The LEDs 151 and 152 are, preferably, of different colors such as red or yellow, respectively. One diode serves to selectively indicate a low battery condition while the other diode serves to selectively indicate a low air flow condition.

The diodes 151 and 152 are connected to control circuits (see infra) by conductors 153 and 154, respectively, which are disposed on or formed in the outer surface of the liner 150. Likewise the battery 191 or similar power source is also connected to the control circuits on the support by means of a suitable connection 192. Thus, the power source 191 may be readily interchangeably connected and replaced, if necessary.

Figure 3:
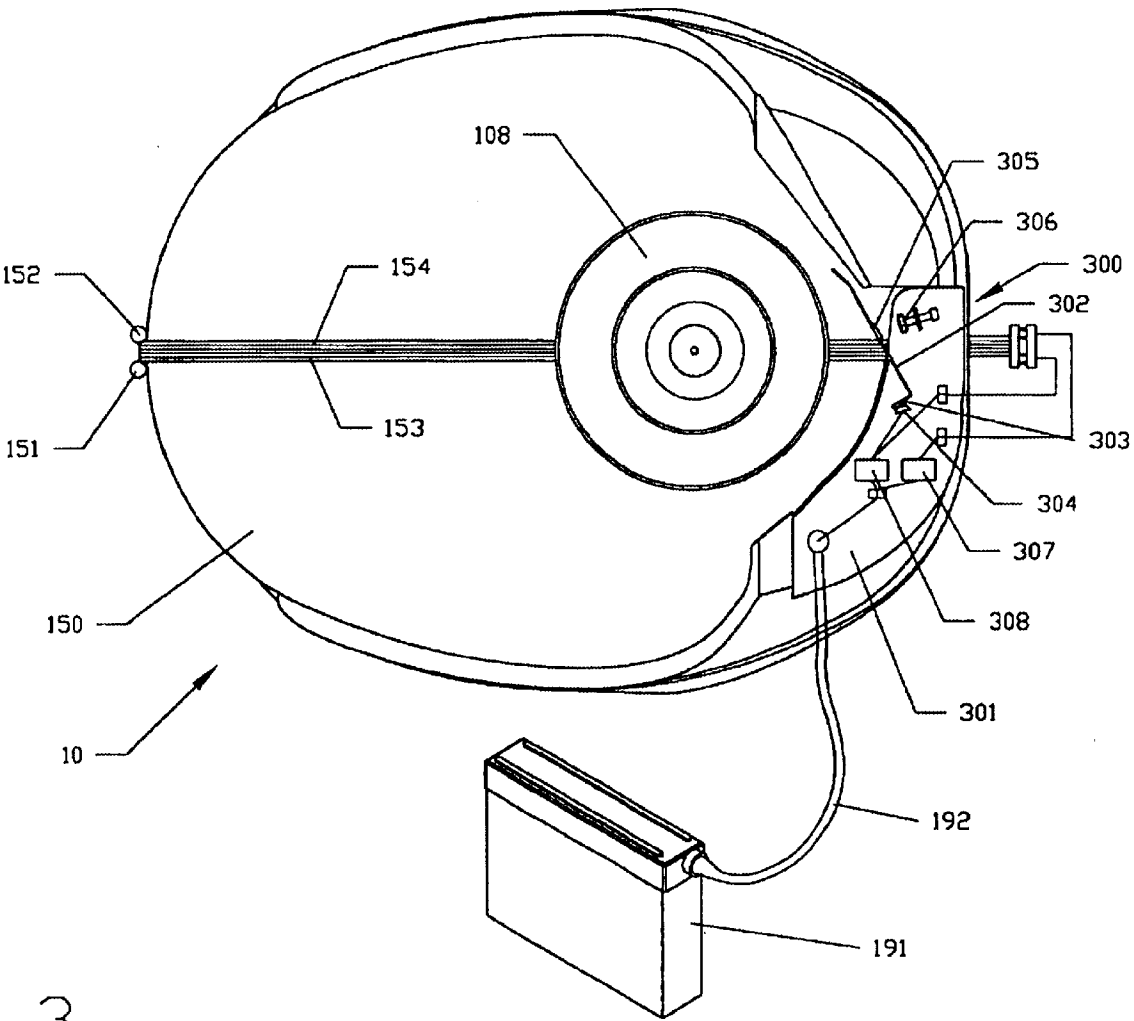
FIG. 3 is a representation of a top view of the inner liner portion of the helmet of the instant invention with a mechanical air flow detector device mounted thereon.

Referring now to FIG. 3, there is shown a plan (or top) view of the inner liner 150 of the helmet of the instant invention. This view includes mechanical apparatus 300 as one embodiment of a means for monitoring the air flow in the headgear system. The mechanical apparatus 300 is, typically, mounted on a support base 301 which is mounted at a convenient location of the helmet structure, typically near the rear of inner liner 150.

A circuit board or similar support 301 is shown mounted on the outer surface of the liner 150. It should be understood that the support 301 can be omitted and the components mounted thereon in this embodiment can be mounted directly to the liner and/or the outer shell 100, if so desired. However, use of a separate support 301 provides for a modular type of construction with advantages in fabrication and repair procedures.

This apparatus includes a pivotally mounted sensor arm 302 which has a sensing magnet 303 mounted on one surface thereof adjacent one end of arm 302. The sensing magnet 303 selectively interacts with a Hall-effect device 304 which is mounted to the base 301 in the apparatus in a conventional manner.

In addition, a positioning magnet 305 is mounted on another surface of the sensor arm 302 adjacent the opposite end of the arm. The positioning magnet 305 selectively interacts with a suitable magnetic reference device 306. The sensing magnet 303 and the positioning net 305 are disposed on the sensor arm 302 on opposite sides of the hinged or pivotal mounting of the arm.

One control circuit, namely the low battery indicator control circuit 307, is also connected to a diode 152 so that the diode is normally not illuminated. However, when the power source, e.g. battery 191, loses a prescribed level of power, diode 152 is activated. (illuminated) and the wearer of the helmet is thereby warned that a new power source is required.

Another control circuit, namely the low airflow indicator control circuit 308, is connected to diode 151 so that the diode is not normally illuminated when airflow in the helmet is at or above a designated rate. However, when the airflow at the helmet is below a specific rate, the diode 151 is illuminated to warn the helmet wearer of the low airflow condition, Thus, the diodes 151 and 152 operate as visual alarms or warnings that the respective input system is not functioning at the prescribed level.

The battery level monitoring circuit 307 is connected to the supply battery 191, typically via a conventional connector cable 192, which can be worn at a remote location by the helmet wearer. For example, the battery can be worn on a belt or other suitable support at the waist of the helmet wearer. Of course, a small, lightweight battery could be mounted in the helmet, if so desired. [As will be described infra, when the voltage output from the battery falls below a set level, the light is illuminated.]

Figure 4:
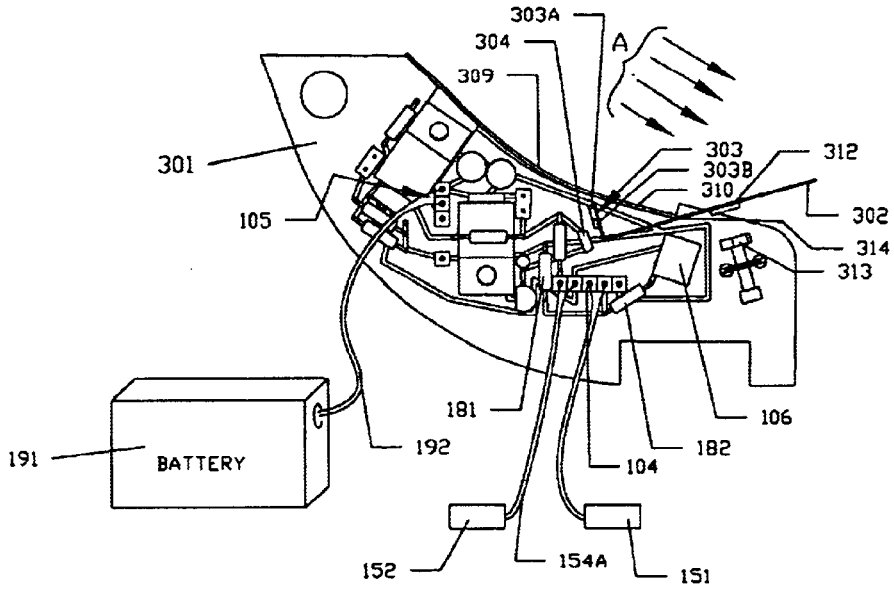
FIG. 4 is a detailed showing of the mechanical air flow detector shown in FIG. 3.

Referring now to FIG. 4, there is provided a more detailed showing of the mechanical air flow detector apparatus 300 of the instant invention. The mechanical detector apparatus 300 is mounted on a support base 301 fabricated of any suitable material such as Polycarbonate or the like. The base 301 has conductors formed thereon or therein in any suitable fashion as, for example, included in any printed circuit fabrication process, technique, or the like. The conductors on the, base 301 are used to interconnect the various components of the control circuits 307 and 308, respectively. For example, battery 191 is connected to the conductors and electrical components in apparatus 300 at connector 105 in conventional manner via battery conductor 192 (see also FIG. 3).

The sensor arm 302 is hingedly or pivotally mounted to an upright Section 309 of the support board 301 by means of flexible strip 310 which is formed of stainless steel, for example. The sensor arm 302 is an elongated arm fabricated of rigid, but lightweight material such as Polycarbonate film. In particular, one end segment of strip 310 is adhered to section 309 and the other end segment is adhered to the sensor arm 302 so that the flexible strip 310 (and, thus, the sensor arm 302) pivots around the intermediate axis 314 of the strip 310.

A magnetic device 303 is affixed to one end of the sensor arm 302. In a preferred embodiment, (though not required), magnetic device 303 comprises a pair of magnets 303A and 303B disposed in opposing polarity. The pair of magnets produces an enhanced switching operation as discussed infra.

A Hall-effect device 304 is mounted on support base 301 in close proximity to the end of sensor arm 302 and magnetic device 303 thereon. The Hall-effect device 304 reacts to magnetic device 303 which is selectively positioned relative thereto as sensor arm pivots 302 around the intermediate axis 314 of strap 310.

As shown, LED 152 is connected to the control circuit associated with the Hall-effect device 304 at connector block 104 by connectors 154A which are equivalent to conductor 154 shown in FIGS. 2 and 3. The operation of the Hall-effect device 304 acts as a switch to selectively connect LED 152 to the battery 191 which is connected to connector block 105 whereby LED 152 is selectively activated.

A positioning magnet 312 is mounted adjacent the opposite end of sensor arm 302 in any suitable fashion. In one embodiment, the magnet 312 can be in the form of a magnetic tape which adheres to the sensor arm.

A repulsion magnet 313 is mounted to the support base 301. In a preferred embodiment, the magnet 313 is adjustably mounted so that the position relative to sensor arm 302 can be selectively adjusted.

In operation, the polarities are selected such that positioning magnet 312 is effectively repulsed from the reference magnet 313 wherein sensor arm 302 rotates counterclockwise around pivot axis 314. In a first condition, which is representative of zero (or very low) air flow in the apparatus, there is no significant restraint on arm 302. In this condition, the sensing magnet device 303 is positioned adjacent to the Hall-effect device 304 whereby the associated circuitry is operative to activate the yellow LED 152 to represent low or insufficient air flow in the helmet system.

In the condition where air flow exists in the helmet system, as represented by arrows A, air pressure is exerted on the positioning end of sensor arm 302. This pressure causes the sensor arm 302 to rotate clockwise around the hinge pivot 314 and against the repelling force of the magnets 312 and 313.

As the sensor arm pivots, the magnet 303 is moved away from the Hall-effect device 304 thereby altering the operation of the control circuit 308 (see FIG. 3). In essence, when the sensing magnet 303 is removed from proximity thereto, the Hall-effect sensor 304 acts as a switch and deactivates the yellow LED 152 which indicates that proper or sufficient air flow exists in the helmet system.

In a preferred embodiment, the pair of magnets 303A and 303B are arranged back-to-back to enhance the polarity thereof. That is, a greater magnetic influence is made on the Hall-effect device 304 when the polarity interface of magnets 303A and 303B moves into and out of proximity to the Hall-effect device.

In this embodiment, the operation of the warning light LED 152 is directly related to the actual air pressure in the helmet system. Proper calibration of the system is, typically controlled by the positioning of the components, especially positioning and repelling the magnets 312 and 313 respectively.

In the embodiment described relative to FIG. 4, the low battery indicator LED 152 has internal circuitry connected to the control circuitry 307, for example, at connector block 104. This control circuit 307 is arranged, in conventional fashion, such as a voltage divider comprising resistors 181 and 182 (along with trimpot 106 for adjustment), to produce a threshold signal when the output from battery 191 falls below a prescribed level. This threshold signal is applied to LED 152 which is activated thereby to produce an indication of low voltage to the wearer of the helmet.

Figure 5:
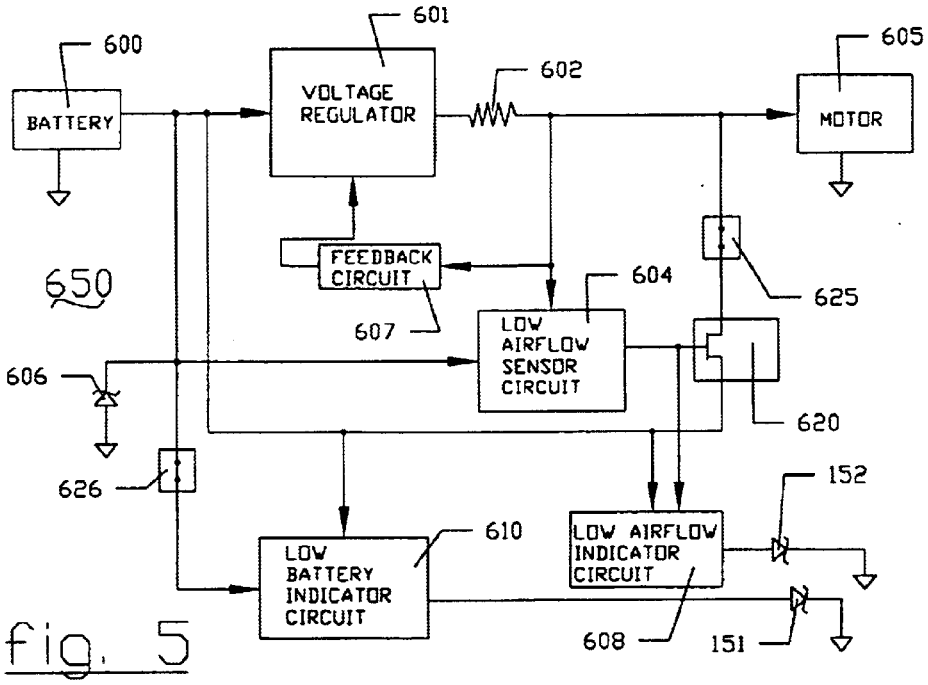
FIG. 5 is a block diagram of an electrical detector system for use with the helmet of the instant invention.

Referring now to FIG. 5, there is shown a block diagram of a control circuit apparatus 650 which provides an alternative control apparatus for the air monitoring system in the helmet system. Through the control circuit apparatus 650, the air flow in the helmet 10 (or head-gear) may be monitored as a function of the power requirements of the motor 605 of fan 108.

A battery 600 (similar to battery 191 shown in FIG. 2) is connected to a voltage regulator 601 which can include a conventional voltage divider network comprising resistors which produce a predetermined voltage at the junction of the resistors.

In a preferred embodiment, the voltage regulator is designed to supply a constant current to current whereby the output voltage is regulated as a function of the current through current sensor 602, as discussed infra.

The voltage regulator 601 is connected to the fan motor 605 via a current sensing resistor 602. Thus, at the optimum operation of the system, the operation of the fan and, thus, fan motor 605 establishes a predetermined voltage level from the voltage regulator 601 to the fan motor.

As the system is utilized, the voltage drop across the current sensing resistor 602 changes due to either reduced battery output capability, a clogged filter in the head gear system which causes the fan to require less power because of the lower air flow load or the like.

The feedback circuit 607 is connected from the current sensing resistor 602 to an input of the voltage regulator 601 to maintain the current supplied to the fan motor 605 substantially constant or at least within a prescribed range level. The voltage level from the voltage regulator 601 is also supplied to one terminal of a comparator circuit included in the low air flow sensor circuit 604. The other terminal of the comparator in the sensor circuit 604 is connected to receive a reference voltage, typically 2.5 volts, as established by an integrated circuit device such as a Zener diode 606, for example. The low air flow sensor circuit 604 thus compares a fixed reference voltage from the Zener diode with the voltage at the input to fan motor 605 as detected across current sensing resistor 602.

The low airflow sensor circuit 604 is operative to selectively connect the battery 600 directly to the motor 605 via a switch 620 which can be, for example, an FET which is connected between the fan motor 605 and the battery 600. The switch 620 is turned off in the normal state. However, when the low air flow sensor circuit 604 produces an output signal representative of a low airflow condition, the switch is turned on and connects the battery 600 directly to the fan motor 605. This connection provides a relatively high spike of voltage to the fan motor 605 to increase air flow through the system. That is, in the event that the voltage at the output of the regulator 601 rises above a specified level the output of the battery 600 is connected directly to the motor 605 for a short time.

The output of the low air flow sensor circuit 604 is also connected to an input of the low air flow indicator circuit 608 which can comprise a comparator circuit. Another input of a comparator circuit in low air flow sensor circuit 604 is connected to the Zener diode 606 to receive the reference voltage therefrom. The output of low air flow indicator circuit 608 is connected to LED 152 (see FIGS. 1–4). Thus, so long as the voltage at the voltage regulator output 601 remains above the reference voltage at the Zener diode 606, the comparator in the low air flow sensor circuit 604 produces an output signal which does not activate the low air flow indicator 608. The low air flow indicator 608, therefore, produces a signal which reverse biases the LED 152 and LED 151 remains off.

Conversely, when the voltage at the voltage regulator output goes above the reference voltage supplied by the Zener diode 606, the comparator in sensor circuit 604 produces an output signal which activates airflow indicator circuit 608 to produce a signal which forward biases the LED 152 which is, thus, illuminated to indicate a low air flow condition. This illumination of LED 152 signals the user to clean or replace the filter of the system in order to obtain proper air flow in the system.

The low battery indicator circuit 610, typically, includes a comparator circuit and is connected to ascertain the level of the voltage produced by battery 600 relative to the reference voltage at Zener diode 606. When the voltage level falls below a specified level, the low battery circuit 610 produces a signal to selectively activate LED 611 (typically a red LED). This warning alerts the user of the helmet to replace (or recharge) the battery 600 so that the system operates properly.

It is contemplated that one optional jumper circuits 625 and 626 can be connected in the circuits as shown in order to adjust the output of the voltage levels in the system in the event that a battery of a different voltage output is used in the circuit.

Thus, there is shown and described a unique design and concept of an air filtration and control system including head gear. While this description is directed to a particular embodiment, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

What is claimed is:

1. An air flow control system comprising, a lightweight headgear structure, a fan mounted to said headgear structure to generate air flow adjacent said headgear structure, a power supply connected to supply power to said fan, air flow monitoring means mounted to said headgear structure to monitor the air flow adjacent to said headgear structure, said air flow monitoring means includes a pivotally mounted arm which is selectively positioned by an air flow around said headgear structure, and indicia means connected with said air flow monitoring means to provide an indication of a predetermined operating condition thereof.

2. The system recited in claim 1 wherein, said power supply comprises a battery.

3. The system recited in claim 2 including, a battery voltage monitoring means to monitor the voltage level produced by said battery.

4. The system recited in claim 1 including, a shroud adapted for covering said headgear structure.

5. The system recited in claim 1 wherein, said indicia means comprises a first light emitting diode.

6. The system recited in claim 1 including, a reference magnet mounted to said headgear structure adjacent to said arm, and a positioning magnet mounted on said arm and adapted to interact with said reference magnet to locate said arm.

7. The system recited in claim 6 including, a Hall-effect device mounted on said headgear structure, a sensing magnet mounted on said arm to selectively alter the operation of said Hall-effect device as a function of the position of said arm.

8. The system recited in claim 1 including, second indicia means connected to said power supply to provide an indication of a predetermined operating condition thereof.

9. The system recited in claim 8 wherein, said second indicia means comprises a light emitting diode.

10. An air flow control system comprising, a lightweight headgear structure, a fan mounted to said headgear structure to generate air flow around said headgear structure, a power supply connected to supply power to said fan to produce air flow adjacent to said headgear structure, said power supply comprises a battery, a battery voltage monitoring means to monitor the voltage level produced by said battery, air flow monitoring means, said air flow monitoring means including a mechanical apparatus mounted to said headgear structure to monitor the air flow adjacent to said headgear structure and an electrical apparatus to monitor the operation of said fan and the airflow produced thereby, first indicia means connected with said air flow monitoring means to provide an indication of a predetermined operating condition thereof relative to the airflow adjacent to said headgear structure, and second indicia means connected to said power supply to provide an indication of a predetermined operating condition thereof.

11. The system recited in claim 10 wherein, said first and second indicia means each comprises a light emitting diode.

12. The system recited in claim 10 wherein, said first indicia means is connected to said mechanical apparatus to provide an indication of a predetermined operating condition thereof.

13. The system recited in claim 10 wherein, said mechanical apparatus of said air flow monitoring means includes a pivotally mounted arm which is selectively positioned by an air flow around said headgear structure.

14. The system recited in claim 13 including, a reference magnet mounted to said headgear structure adjacent to said pivotally mounted arm, and a positioning magnet mounted on said arm and adapted to interact with said reference magnet to locate said arm.

15. The system recited in claim 14 including, a Hall-effect device mounted on said headgear structure, a sensing magnet mounted on said arm to selectively alter the operation of said Hall-effect device as a function of the position of said arm.

16. The system recited in claim 10 wherein, said electrical apparatus of said air flow monitoring means includes a current sensing device for determining the amount of current supplied to said fan.

17. The system recited in claim 16 including, voltage regulator means for supplying a relatively fixed voltage to said current sensing device, and a sensing circuit connected to said current sensing device for detecting an excessive current in said current sensing means.

18. The system recited in claim 17 wherein, said sensing circuit includes an operational amplifier.

19. The system recited in claim 10 wherein, said electrical apparatus of said air flow monitoring means includes a voltage sensing device for determining the amount of voltage supplied to said fan.

20. The system recited in claim 19 including, a current controlling means for supplying a relatively fixed current to said voltage sensing device.

21. An air flow control system comprising, a lightweight headgear structure, a fan mounted to said headgear structure to generate air flow adjacent said headgear structure, a power supply connected to supply power to said fan, air flow monitoring means mounted to said headgear structure to monitor air flow adjacent to said headgear structure, said air flow monitoring means includes a current sensing device for measuring the level of current supplied to said fan and a voltage sensing device for determining the level of voltage supplied to said fan, and, indicia means connected with said air flow monitoring means to provide an indication of a predetermined operating condition thereof.

22. The system recited in claim 21 including, voltage regulator means for supplying a relatively fixed voltage to said current sensing device, and a sensing circuit connected to said current sensing device for detecting an excessive current in said current sensing means.

23. The system recited in claim 22 wherein, said sensing circuit includes an operational amplifier.

24. The system recited in claim 22 including a voltage detecting circuit connected to said power supply to detect the output level therefrom.

25. The system recited in claim 21 including, a current controlling means for supplying a relatively fixed current to said voltage sensing device.

26. The system recited in claim 21 wherein, said power supply comprises a battery.

27. The system recited in claim 26 including, a battery voltage monitoring means to monitor the voltage level produced by said battery.

28. The system recited in claim 27 including, second indicia means connected to said battery voltage monitoring means to provide an indication of a predetermined operating condition thereof.

* * * * *